US012144404B2

(12) United States Patent
Li

(10) Patent No.: US 12,144,404 B2
(45) Date of Patent: Nov. 19, 2024

(54) WRISTBAND AND WRISTWATCH

(71) Applicants: Wuhan Tianma Micro-Electronics Co., Ltd., Wuhan (CN); Wuhan Tianma Microelectronics Co., Ltd. Shanghai Branch, Shanghai (CN)

(72) Inventor: Xinming Li, Shanghai (CN)

(73) Assignees: Wuhan Tianma Micro-Electronics Co., Ltd., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 559 days.

(21) Appl. No.: 17/204,347

(22) Filed: Mar. 17, 2021

(65) Prior Publication Data

US 2022/0202145 A1 Jun. 30, 2022

(30) Foreign Application Priority Data

Dec. 29, 2020 (CN) ..... 202011594117.9

(51) Int. Cl.
*A44C 5/00* (2006.01)

(52) U.S. Cl.
CPC ..... *A44C 5/0053* (2013.01)

(58) Field of Classification Search
CPC ... A44C 5/0053; A44C 5/0007; A44C 5/0015; A44C 5/0023; A44C 5/003; A44C 5/0038; A44C 5/0046; A44C 5/0084
USPC ..... 224/164–180; 368/282; 417/405; 2/DIG. 3
See application file for complete search history.

(56) References Cited

U.S. PATENT DOCUMENTS 4,016,616 A * 4/1977 Walters ..... B63C 11/46 114/315
6,461,125 B1 * 10/2002 Terasawa ..... F04B 45/00 368/282
7,618,384 B2 * 11/2009 Nardi ..... A61B 5/6829 601/149
9,781,982 B2 * 10/2017 Song ..... G06F 1/163
9,781,984 B2 * 10/2017 Baranski ..... A44C 5/20
10,206,623 B2 * 2/2019 Harrison-Noonan ..... A61B 5/681

(Continued)

FOREIGN PATENT DOCUMENTS

CN 206946593 U 1/2018
CN 108552685 A 9/2018
CN 109008094 A 12/2018

(Continued)

*Primary Examiner* — Scott T McNurlen
(74) *Attorney, Agent, or Firm* — Anova Law Group, PLLC

(57) ABSTRACT

The present disclosure provides a wristband and wristwatch. The wristband includes a wristband main body, configured to encircle on a wearing body, that the wristband main body includes a belt body and an inflatable bag arranged on the belt body, and a release structure is configured in a wall part of the wristband main body that surrounds the inflatable bag and the release structure communicates with an inner cavity of the inflatable bag, to release gas from the inflatable bag; and an inflating device, provided on the wristband main body, that the inflating device includes an inflating component and a driving component, the inflating component communicates with the inflatable bag, and the driving component is configured to move following a move of the wearing body and to drive the inflating component to inflate the inflatable bag.

21 Claims, 7 Drawing Sheets

(56) References Cited

U.S. PATENT DOCUMENTS

| | | | | |
|---|---|---|---|---|
| 2006/0003301 | A1* | 1/2006 | Biggins | A63H 3/06 434/267 |
| 2014/0169993 | A1* | 6/2014 | Berzak | F04B 15/08 417/472 |

FOREIGN PATENT DOCUMENTS

| | | | | |
|---|---|---|---|---|
| CN | 110638616 | A | | 1/2020 |
| JP | 2009240511 | A | * | 10/2009 |

* cited by examiner

WRISTBAND AND WRISTWATCH

CROSS-REFERENCE TO RELATED APPLICATION

This application claims the priority of Chinese Patent Application No. CN202011594117.9, filed on Dec. 29, 2020, the entire contents of all of which are incorporated herein by reference.

FIELD OF THE DISCLOSURE

The present disclosure generally relates to the field of display technologies and, in particular, relates to a wristband and a wristwatch.

BACKGROUND

With continuous development and progress of technologies, various wristwatches are becoming more and more popular, especially for smart watches. The smart watches are favored by more and more users, because the smart watches can not only satisfy a wearer's time acquisition, but also provide the wearer with some parameter feedback such as physical condition information. Accordingly, requirements for wristwatch experience are getting higher and higher.

For example, the wearer has different requirements for wristband slackness of a wristwatch when the wearer is in different states. When the wearer is in an exercising state, his/her requirement for a wristband is to be tighter to avoid discomfort caused by random shaking of the wristband during exercising. However, when the wearer is in a non-exercising state, his/her requirement for the wristband is to be relatively looser and more comfortable compared to the exercising state.

To meet requirements of a wearer for the wristband slackness under different states, existing wristbands are mainly adjusted by adjusting a length at a position surrounding the wearer's wrist, which is complicated to operate and is not conducive to the adjustment of the wristband slackness.

BRIEF SUMMARY OF THE DISCLOSURE

One aspect of the present disclosure provides a wristband including a wristband main body, configured to encircle on a wearing body, that the wristband main body includes a belt body and an inflatable bag arranged on the belt body, and a release structure is configured in a wall part of the wristband main body that surrounds the inflatable bag and the release structure communicates with an inner cavity of the inflatable bag, to release gas from the inflatable bag; and an inflating device, provided on the wristband main body, that the inflating device includes an inflating component and a driving component, the inflating component communicates with the inflatable bag, and the driving component is configured to move following a move of the wearing body and to drive the inflating component to inflate the inflatable bag.

Another aspect of the present disclosure provides a wristwatch, including: a wristband, including a wristband main body, configured to encircle on a wearing body, that the wristband main body includes a belt body and an inflatable bag arranged on the belt body, and a release structure is configured in a wall part of the wristband main body that surrounds the inflatable bag and the release structure communicates with an inner cavity of the inflatable bag, to release gas from the inflatable bag; and an inflating device, provided on the wristband main body, that the inflating device includes an inflating component and a driving component, the inflating component communicates with the inflatable bag, and the driving component is configured to move following a move of the wearing body and to drive the inflating component to inflate the inflatable bag; and a dial, connected to the wristband, and together with the wristband to form a closed ring, that the release structure is arranged facing towards the closed ring.

Other aspects of the present disclosure can be understood by those skilled in the art in light of the description, the claims, and the drawings of the present disclosure.

BRIEF DESCRIPTION OF THE DRAWINGS

To more clearly illustrate the technical solution of the present disclosure, the accompanying drawings used in the description of the disclosed embodiments are briefly described hereinafter. The following drawings are merely examples for illustrative purposes according to various disclosed embodiments and are not intended to limit the scope of the present disclosure. Other drawings may be derived from such drawings by a person with ordinary skill in the art without creative efforts.

DETAILED DESCRIPTION

Figure 1:
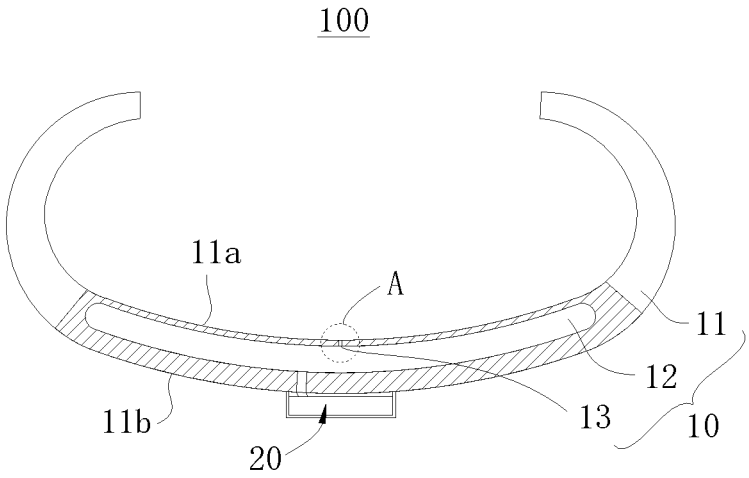
FIG. 1 is an overall structural diagram of an exemplary wristband according to various embodiments of the present disclosure.

Features and exemplary embodiments of various aspects of the present disclosure will be described in detail below. In the following detailed description, many alternative details are proposed to provide a comprehensive understanding of the present disclosure. However, it is understandable to those skilled in the art that the present disclosure can be implemented without some of these details. The following description of the embodiments is only to provide a better understanding of the present disclosure by showing examples of the present disclosure. In the drawings and the following description, at least part of well-known structures and technologies are not shown to avoid unnecessary blurring of the present disclosure; and, for clarity, sizes of some structures may be exaggerated. In addition, the features, structures or characteristics described below may be combined in any suitable manner in one or more embodiments.

Orientation words appearing in the following description are all directions shown in the drawings, and do not limit structures of the wristband and wristwatch of the present disclosure. In the description of the present disclosure, unless otherwise clearly defined and limited, terms "mounting" and "connection" should be understood in a broad sense, for example, it can be a fixed connection, or a detachable connection, or integrally connected; and it can be directly connected or indirectly connected. For a person with ordinary skill in the art, alternative meanings of the above-mentioned terms in the present disclosure can be understood according to actual circumstances.

With continuous popularity of wristwatches, wearers have higher and higher requirements for experience of the wristwatches. For example, slackness adjustment of wristbands of the wristwatches under different exercising states is an important indicator when buying a wristwatch. In existing wristwatches, a slackness adjustment mode of the wristbands mostly adopts a form of a lock to adjust a length at a position surrounding a wrist of a wearer to adjust the slackness, which is complicated to operate and is not conducive to the slackness adjustment of the wristband. There are also some wristwatches that actively inflate an inside of a wristband to adjust the slackness of the wristband, which mainly use a power source such as an air pump to inject gas into the inside of the wristband or extract the gas from the inside the wristband according to needs to achieve a purpose of adjusting the slackness. Although this setting method can meet the slackness adjustment, it requires an external power source. Setting of the power source needs to consume a certain amount of electric energy and needs to be equipped with a corresponding control system, which makes an overall structure of the wristband complex and costly.

Based on the above technical problems, the embodiments of the present disclosure provide a new wristband, which can adjust slackness according to exercising states of a wearer, is easy to operate, and facilitates the slackness adjustment of the wristband. To better understand the present disclosure, the wristband and wristwatch according to the embodiments of the present disclosure will be described in detail below with reference to FIGS. 1 to 17.

Figure 2:
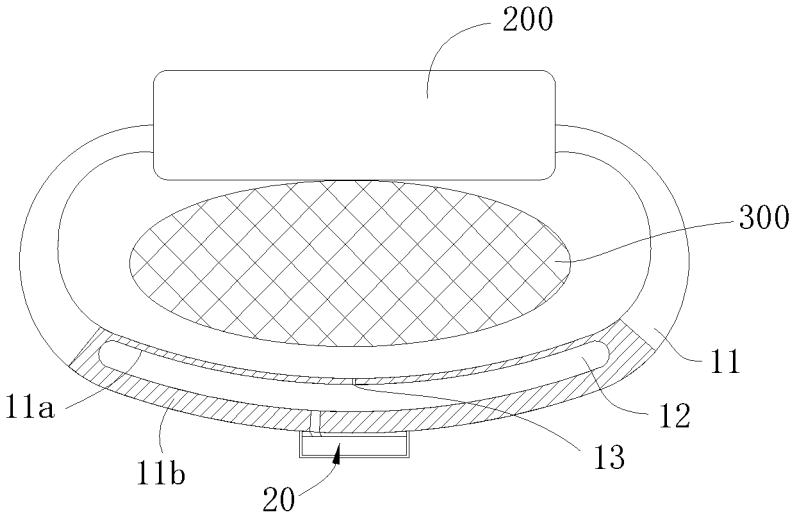
FIG. 2 is a use state diagram of an exemplary wristband in a relaxed state according to various embodiments of the present disclosure.
Figure 3:
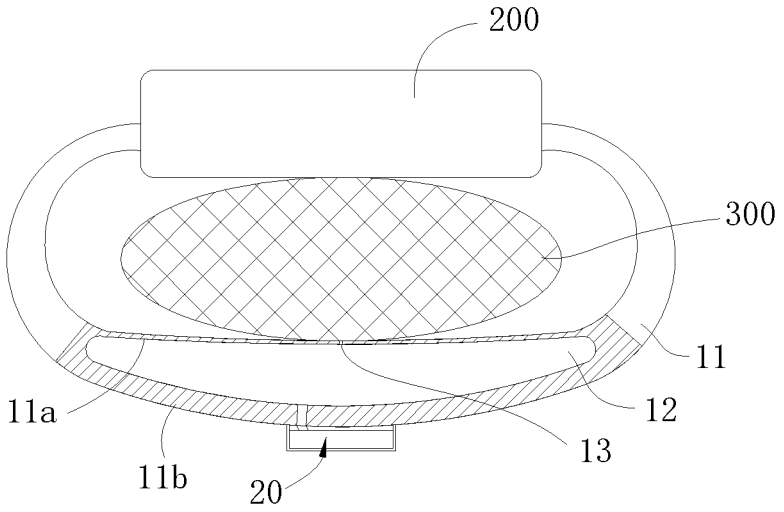
FIG. 3 is a use state diagram of an exemplary wristband in a tightened state according to various embodiments of the present disclosure.
Figure 4:
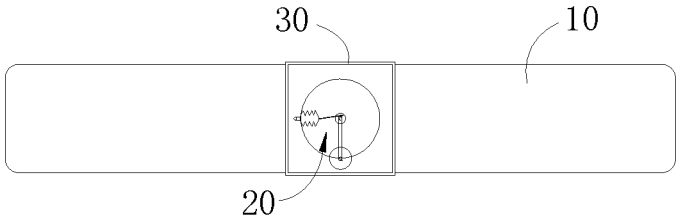
FIG. 4 is a top view of an exemplary wristband according to various embodiments of the present disclosure.
Figure 5:
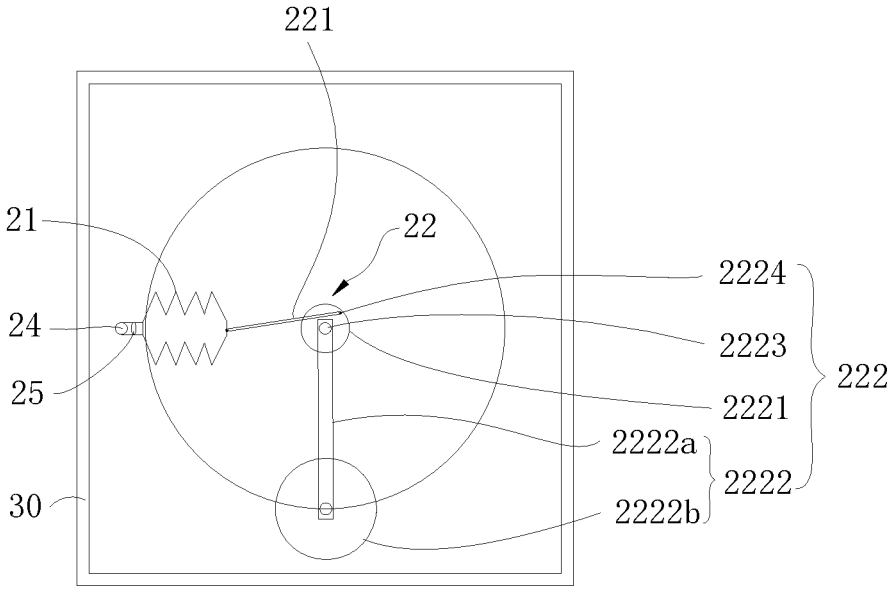
FIG. 5 is a schematic structural diagram of an exemplary inflating device and an exemplary mounting frame according to various embodiments of the present disclosure.

As shown in FIGS. 1 to 5, FIG. 1 is a schematic structural diagram of an exemplary wristband according to various embodiments of the present disclosure, FIG. 2 is a use state diagram of an exemplary wristband in a relaxed state according to various embodiments of the present disclosure, and FIG. 3 is a use state diagram of an exemplary wristband in a tightened state according to various embodiments of the present disclosure. As shown in FIGS. 4 and 5, FIG. 4 is a top view of an exemplary wristband according to various embodiments of the present disclosure, and FIG. 5 is a schematic structural diagram of an exemplary inflating device and an exemplary mounting frame according to various embodiments of the present disclosure.

A wristband 100 provided by the embodiments of the present disclosure includes a wristband main body 10 and an inflating device 20. The wristband main body 10 is configurated to encircle on a wearing body 300. The wristband main body 10 includes a belt body 11 and an inflatable bag 12 arranged on the belt body 11. A release structure 13 is configured in a wall part of the wristband main body that surrounds the inflatable bag 12 and the release structure 13 communicates with an inner cavity of the inflatable bag 12 to release gas from the inflatable bag 12. The inflating device 20 is arranged on the wristband main body 10, and the inflating device 20 includes an inflating component 21 and a driving component 22. The inflating component 21 communicates with the inflatable bag 12, and the driving component 22 moves following a move of the wearing body 300 to drive the inflating component 21 to inflate the inflatable bag 12.

When used in a wristwatch and encircled on the wearing body 300, the wristband 100 provided by the embodiments of the present disclosure will adjust its slackness to the wearing body 300 according to exercising states of the wearing body 300. When the wearing body 300 is in a non-exercising state, the release structure 13 communicating with the inner cavity of the inflatable bag 12 can be configured to release the gas from the inflatable bag 12 to loosen the wristband 100. For example, when a wearer is exercising, the driving component 22 will move following a move of the wearer to drive the inflating component 21 to inflate the inflatable bag 12, making the inflatable bag 12 larger, and ensuring that the wristband 100 is tighter on the wearer's wrist. The operation is simple, and is conducive to the slackness adjustment of the wristband 100.

In addition, in the wristband 100 provided by the embodiments of the present disclosure, the driving component 22 of the inflating device 20 moves following a move of the wearing body 300 to obtain kinetic energy to drive the inflating component 21, so as to meet inflation demand for the inflatable bag 12. There is no need for an externally equipped power source such as an air pump, and no need to be equipped with a corresponding control system to control the power source. An overall structure of the wristband 100 is simple and low in cost.

In some optional embodiments, in the wristband 100 provided by the embodiments of the present disclosure, the belt body 11 of the wristband may be at least partially made of a flexible belt, and the flexible belt has a predetermined deformability under an external force. Optionally, the belt body 11 may be all made of a flexible belt. In some embodiments, the belt body 11 may be made of a flexible belt only where the inflatable bag 12 is provided.

As an optional implementation, the wristband main body 10 may have two opposite free ends in its length direction. When used in a wristwatch, the two opposite free ends may be configured to connect to a dial 200, and together with the dial 200 to form a closed ring.

As an optional implementation, in the wristband 100 provided by the embodiments of the present disclosure, the inflatable bag 12 is arranged inside the belt body 11 and divides the belt body 11 into a first section 11*a* and a second section 11*b* oppositely disposed to each other. In an arrangement direction of the first section 11*a* and the second section 11*b*, a wall thickness of the first section 11*a* is smaller than a wall thickness of the second section 11*b*. When used in a wristwatch and encircled on the wearing body 300, the first section 11*a* is disposed facing towards the wearing body 300 and the second section 11*b* is disposed further away from the wearing body 300.

As shown in FIG. 2, when the inflatable bag 12 of the wristband 100 is in an uninflated state, a gap may be formed between the first section 11*a* formed on the belt body 11 and the wearing body 300, and the wristband 100 is in a relaxed state at this time.

As shown in FIG. 3, when the wearing body 300 is in an exercising state, such as the wearing body 300 is in a process of exercising such as running, the driving component 22 moves following a move of the wearing body 300 to drive the inflating component 21 to inflate the inflatable bag 12. When gas enters the inflatable bag 12, a volume of the inflatable bag 12 will become larger, and simultaneously squeeze the first section 11*a* and the second section 11*b* to provide a force of movement to the first section 11*a* and the second section 11*b* in directions away from each other. Since the wall thickness of the first section 11*a* is smaller than the wall thickness of the second section 11*b*, the first section 11*a* has a weaker ability to resist external forces than the second section 11*b*, and the filled gas will move in advance to a side where the first section 11*a* is located. The first section 11*a* will deform in a direction away from the second section 11*b* to contact the wearing body 300, reducing or eliminating the gap with the wearing body 300, so that the wristband 100 is in a tightened state. An automatic tightening requirement of the wristband 100 of the wearing body 300 from the non-exercising state to the exercising state is satisfied.

Figure 6:
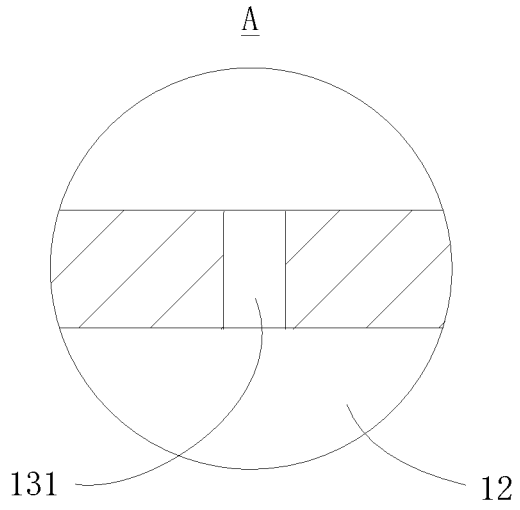
FIG. 6 is an enlarged view of A in FIG. 1.

As shown in FIG. 6, FIG. 6 is an enlarged view of A in FIG. 1. In some optional embodiments, the release structure 13 includes a leak hole 131 which communicates with the inner cavity of the inflatable bag 12 and is disposed facing towards the wearing body 300. By making the release structure 13 include the leak hole 131, the gas in the inflatable bag 12 can leak slowly. Since the leak hole 131 is set facing towards the wearing body 300, when the wearing body 300 is in the exercising state, the inflating device 20 inflates the inflatable bag 12 to cause the inflatable bag 12 to expand, and the leak hole 131 is temporarily attached to the wearing body 300 to maintain the tightened state of the wristband 100. When the wearing body 300 is in the non-exercising state, the driving component 22 will also stop providing power to the inflating component 21, and the gas in the inflatable bag 12 will slowly leak under an action of the leak hole 131, and the slackness adjustment of the wristband 100 will be automatically realized.

In some optional embodiments, the leak hole 131 may be provided in the first section 11*a* and communicate with the inflatable bag 12. A quantity of the leak hole 131 may be set according to parameters such as a size of the inflatable bag 12, and leak rate requirements. There may be one leak hole, or two or more leak holes. When there are two or more leak holes, they may be spaced apart in a direction surrounding the wearing body 300.

Referring to FIGS. 4 to 6, as an optional implementation, in the wristband 100 provided by the embodiments of the present disclosure, the driving component 22 includes an adapter 221 and a moving member 222, that are rotatably connected to each other. One end of the adapter 221 away from the moving member 222 is connected to the inflating component 21, and the moving member 222 moves following a move of the wearing body 300 to drive the inflating component 21 to expand and contract through the adapter 221. The driving component 22 adopts the above-mentioned form, and the moving member 222 can be connected to the inflating component 21 through the adapter 221, so that kinetic energy generated by the moving member 222 moving following a move of the wearing body 300 can be converted into expanding and contracting movement of the inflating component 21, which can reliably meet inflation requirements of the inflatable bag 12.

In some optional embodiments, in the wristband 100 provided by the embodiments of the present disclosure, the moving member 222 can be rotatably connected to the wristband main body 10. A rotation center of the moving member 222 and the wristband main body 10 is spaced apart from a rotation center of the adapter 221 and the moving member 222. The moving member 222 moves following a move of the wearing body 300 and rotates relatively to the wristband main body 10 to drive the inflating component 21 to expand and contract through the adapter 221. By making the moving member 222 and the wristband main body 10 rotatably connected, when the wearing body 300 is in the exercising state, the moving member 222 can make a full circle rotation relative to the wristband main body 10 using the rotation center of the wristband main body 10 as a center of rotation, to drive the adapter 221 to move along a predetermined trajectory to alternately stretch and compress the inflating component 21 to fulfill the inflation requirement for the inflatable bag 12.

As an optional implementation, the moving member 222 may include a turntable 2221 and a swinging part 2222 connected to the turntable 2221. A center of the turntable 2221 is rotatably connected to the wristband main body 10 through a first shaft 2223. The swinging part 2222 moves following a move of the wearing body 300 and drives the turntable 2221 to rotate with the first shaft 2223 as a center of rotation. The adapter 221 is rotatably connected to the turntable 2221 through a second shaft 2224, and the second shaft 2224 and the first shaft 2223 are spaced apart from each other. The moving member 222 adopts the above-mentioned structural form, which can make movements of the wearing body 300 in different directions be used, so that the moving member 222 can enable a whole body formed by the swinging part 2222 and the turntable 2221 to make a full circle rotation relative to the wristband main body 10, by using the first shaft 2223 as a rotation center, and then the adapter 221 is driven to move through the second shaft 2224 to realize the stretching and compressing of the inflating component 21.

In some optional embodiments, the swinging part 2222 includes a swing arm 2222*a* and a pendulum 2222*b*. One end of the swing arm 2222*a* is connected to the turntable 2221, and another end of the swing arm 2222*a* protrudes out of the turntable 2221 along a radial direction of the turntable 2221 and is connected to the pendulum 2222*b*. The swinging part 2222 adopts the above-mentioned structural form, which can amplify the kinetic energy obtained from the wearing body 300, improve driving force of the adapter 221, and then can more easily stretch and compress the inflating component 21, ensuring inflation effect of the inflatable bag 12.

Optionally, the swing arm 2222*a* can adopt a rod structure and be connected to the turntable 2221 in a fixed manner. The pendulum 2222*b* can be a spherical body, and the pendulum 2222*b* can be made of a denser material to ensure that it has more weight while occupying a smaller volume.

In some optional embodiments, the adapter 221 may adopt a rod structure, which is simple in structure and facilitates transmission of kinetic energy between the moving member 222 and the inflating component 21.

As an optional implementation, the inflating component 21 includes a bellows. The bellows has a gas inlet hole and an inflating hole communicating with the inflatable bag 12. An end of the bellows is connected to the driving component 22. The inflating component 21 is in a form of the bellows, which has a simple structure and is easy to stretch and compress. Optionally, the end of the bellows may be connected to the adapter 221 of the driving component 22.

As an optional implementation, in the wristband 100 provided by the embodiments of the present disclosure, when the release structure includes the leak hole 131, a radial size of an interface between the inflating component 21 and the inflatable bag 12 is greater than or equal to a radial size of the leak hole 131. Through the above arrangement, when the wearing body 300 is in the exercising state, an inflation rate of the inflating device 20 to the inflatable bag 12 can be greater than a leak rate of the leak hole 131, which ensures an effective inflation of the inflatable bag 12 and tightening requirements for the wristband 100, when the wearing body 300 is in the exercising state.

In some optional embodiments, in the wristband 100 provided by the embodiments of the present disclosure, a diameter of the leak hole 131 is any value between about 0.05 mm and about 0.1 mm, including two end values of the about 0.05 mm and the about 0.1 mm, and can be optionally about 0.08 mm. A diameter of the interface between the inflating component 21 and the inflatable bag 12 is any value between about 1 mm and about 1.5 mm, including two end values of the about 1 mm and the about 1.5 mm, and can be optionally about 1.2 mm. The leak hole 131 and the interface adopt the above-mentioned sizes, which can reliably ensure requirements that the wristband 100 automatically adjusts the slackness according to the exercising state of the wearing body 300, so as to improve the user experience.

As an optional implementation, in the wristband 100 provided by the embodiments of the present disclosure, the inflating device 20 of the wristband further includes a connecting pipe 24. The connecting pipe 24 communicates with the inflating component 21 and the inflatable bag 12, and the connecting pipe 24 is provided with a second control valve 25, which is unidirectionally communicated from the inflating component 21 to the inflatable bag 12. Through the above arrangement, connection requirement between the inflatable bag 12 and the inflating component 21 can be facilitated, and at a same time, the inflating component 21 can be prevented from sucking back the gas from the inflatable bag 12 when the inflating component 21 is stretched, so as to ensure the inflation effect of the inflatable bag 12.

In some optional embodiments, the wristband 100 provided by the embodiments of the present disclosure further includes a mounting frame 30 disposed on the wristband main body 10. The inflating device 20 is integrated in the mounting frame 30 and is connected to the wristband main body 10 through the mounting frame 30. By setting the mounting frame 30, components of the inflating device 20 such as the inflating component 21, the driving component 22, the connecting pipe 24, etc., can be integrated into the mounting frame 30, which improves overall integration of the inflating device 20 and facilitates disassembly and assembly of the inflating device 20 as well as maintenance, and can ensure overall aesthetic performance of the wristband 100.

As an optional implementation, in the wristband 100 provided by the embodiments of the present disclosure, a whole body of the mounting frame 30 may have a rectangular frame structure. In some embodiments, it may also have a circular, oval or other polygonal frame structure, as long as it can meet integration requirements of the inflating device 20.

In some optional embodiments, the mounting frame 30 and the belt body 11 may be connected to each other by an adhesive connection. In this case, the belt body 11 may be all made of a flexible belt. It can be understood that the adhesive connection between the mounting frame 30 and the belt body 11 is only an optional connection, but the present disclosure is not limited to this connection.

Figure 7:
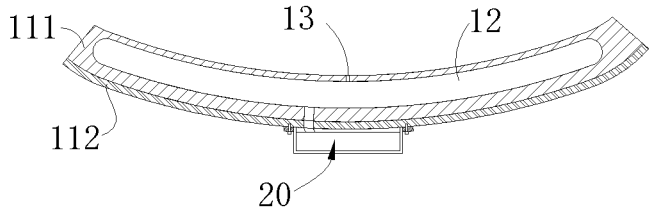
FIG. 7 is a partial structural diagram of an exemplary wristband according to various embodiments of the present disclosure.

As shown in FIG. 7, FIG. 7 is a partial structural diagram of an exemplary wristband according to various embodiments of the present disclosure. In some embodiments, the belt body 11 may also have a flexible portion 111 and a rigid fixing portion 112 that are connected to each other. The inflatable bag 12 is located at the flexible portion 111 and the mounting frame 30 and the rigid fixing portion 112 are detachably connected to each other. Through the above arrangement, deformation requirement of the belt body 11 under action of the inflatable bag 12 can be met, and the slackness adjustment of the wristband 100 can be satisfied. The arrangement of the rigid fixing portion 112 facilitates the detachable connection between the mounting frame 30 and the rigid fixing portion 112 by bolts, rivets, etc., and facilitates the disassembly, assembly and maintenance of the inflating device 20.

As an optional implementation, the wristband 100 provided in the foregoing embodiments of the present disclosure is illustrated with examples in which the inflatable bag 12 is disposed inside the belt body 11, which is an optional implementation manner. In some embodiments, the inflatable bag 12 may also be formed outside of the belt body 11.

Figure 8:
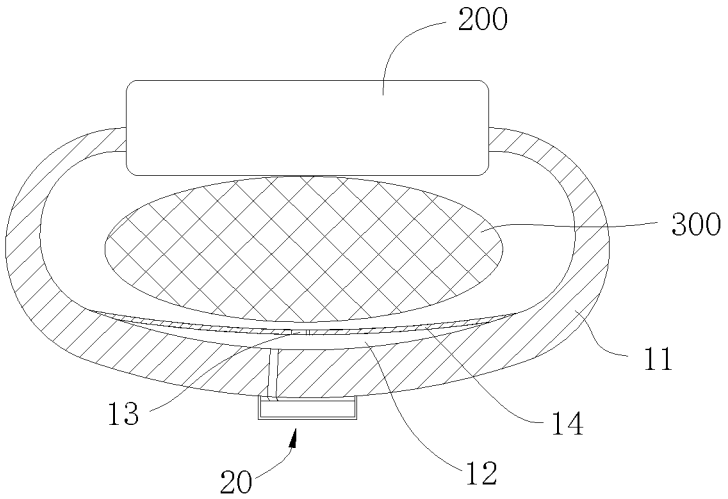
FIG. 8 is a use state diagram of an exemplary wristband in a relaxed state according to various embodiments of the present disclosure.
Figure 9:
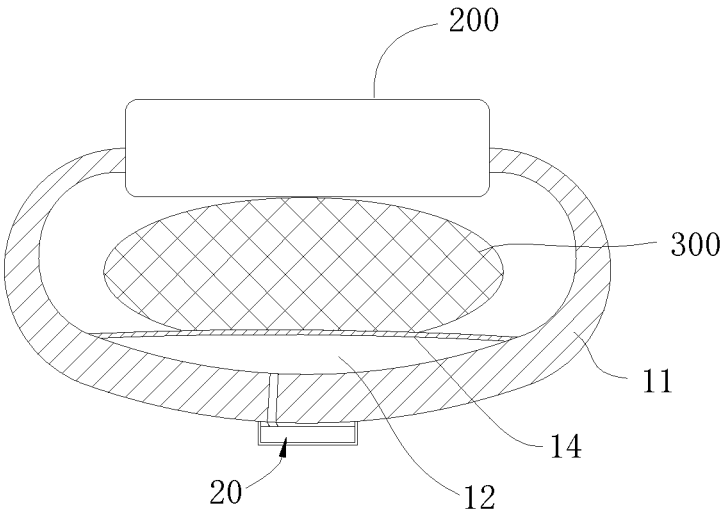
FIG. 9 is a use state diagram of an exemplary wristband in a tightened state according to various embodiments of the present disclosure.

As shown in FIGS. 8 and 9, FIG. 8 is a use state diagram of an exemplary wristband in a relaxed state according to various embodiments of the present disclosure, and FIG. 9 is a use state diagram of an exemplary wristband in a tightened state according to various embodiments of the present disclosure.

Exemplarily, the wristband main body 10 may further include a diaphragm element 14. An outer periphery of the diaphragm element 14 is connected to the belt body 11 to form the inflatable bag 12, and a thickness of the diaphragm element 14 is smaller than a wall thickness of the belt body 11. The diaphragm element 14 is disposed facing towards the wearing body 300 and the belt body 11 is disposed further away from the wearing body 300. The release structure 13 is disposed on the diaphragm element 14. By providing the diaphragm element 14 outside the belt body 11 and connecting the outer periphery of the diaphragm element 14 to the belt body 11, the inflatable bag 12 can also be formed. The inflating component 21 of the inflating device 20 can be connected to the inflatable bag 12. The belt body 11 may also be provided with a connecting hole communicating with the inflatable bag 12, so that the inflating component 21 communicates with the inflatable bag 12 through the connecting hole on the belt body 11, and the driving component 22 inflates the inflatable bag 12 under effect of moving following a move of the wearing body 300.

As shown in FIG. 8, when the wristband 100 provided in the embodiments of the present disclosure is used in a wristwatch and encircles on the wearing body 300, a gap may be formed between the diaphragm element 14 and the wearing body 300 in an initial state. As shown in FIG. 9, when the wearing body 300 is in the exercising state, under moving following a move of the wearing body of the driving component 22 of the inflating device 20, the inflating component 21 is driven to inflate the inflatable bag 12, and the volume of the inflatable bag 12 will increase. Since the thickness of the diaphragm element 14 is less than that of the belt body 11, ability of the diaphragm element 14 to resist external forces is weaker than that of the belt body 11. When the gas in the inflatable bag 12 increases, the diaphragm element 14 will be deformed and move towards a side of the wearing body 300, to reduce or eliminate the gap between the diaphragm element 14 and the wearing body 300, so as to automatically adjust the slackness of the wristband 100 with the movement of the wearing body 300.

Since the release structure 13 is disposed on the diaphragm element 14, when the gas in the inflatable bag 12 continues to increase, so that the diaphragm element 14 is attached to the wearing body 300, the leak hole 131 of the release structure 13 will be attached to the wearing body 300 to ensure the tightened state of the wristband 100. When the wearing body 300 changes from the exercising state to the non-exercising state, the inflating device 20 will stop inflating the inflatable bag 12, so that the gas in the inflatable bag 12 can slowly leak through the leak hole 131 and the wristband 100 enters the relaxed state again.

Figure 10:
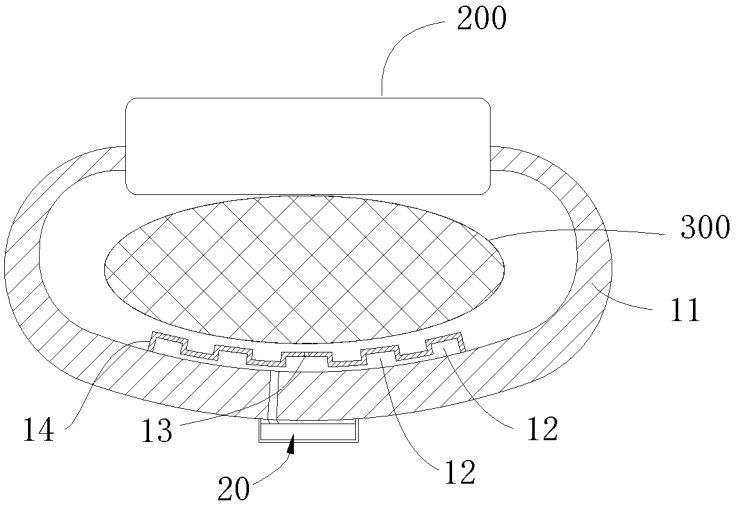
FIG. 10 is a use state diagram of an exemplary wristband in a relaxed state according to various embodiments of the present disclosure.
Figure 11:
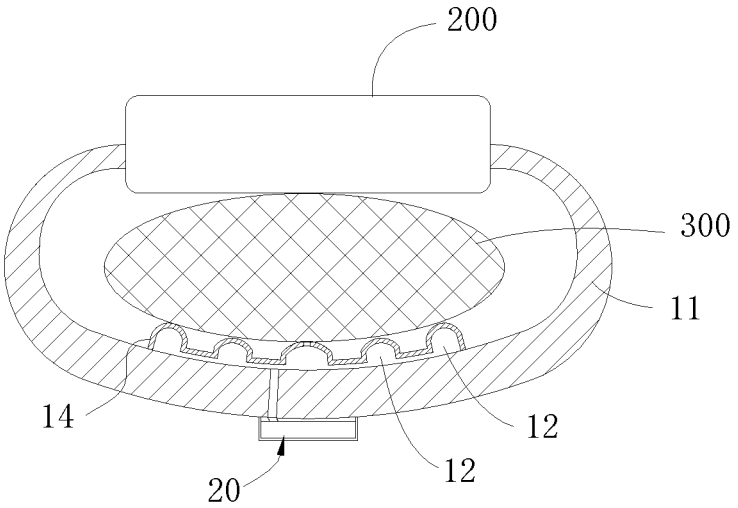
FIG. 11 is a use state diagram of an exemplary wristband in a tightened state according to various embodiments of the present disclosure.

As shown in FIGS. 10 and 11, FIG. 10 is a use state diagram of an exemplary wristband in a relaxed state according to various embodiments of the present disclosure, and FIG. 11 is a use state diagram of an exemplary wristband in a tightened state according to various embodiments of the present disclosure.

As an optional implementation, in the wristband 100 provided by the embodiments of the present disclosure, a quantity of the inflatable bag 12 is two or more, the two or more inflatable bags 12 are spaced apart on the belt body 11, and two adjacent inflatable bags 12 communicate with each other. Through the above arrangement, the inflatable bags 12 can be dispersed, and two adjacent inflatable bags 12 communicate with each other, so that rates of inflation and leak can be improved under a same span.

Optionally, when the quantity of the inflatable bag 12 is two or more and they communicate with each other, the quantity of the release structure 13 can be set according to requirements, and is not limited here.

It is understandable that the wristband 100 provided in the foregoing embodiments of the present disclosure is illustrated by taking the moving member 222 rotatably connected relative to the wristband main body 10 in a process of moving following a move of the wearing body 300 as examples, which is an optional manner, but the present disclosure is not limited to the above manner.

Figure 12:
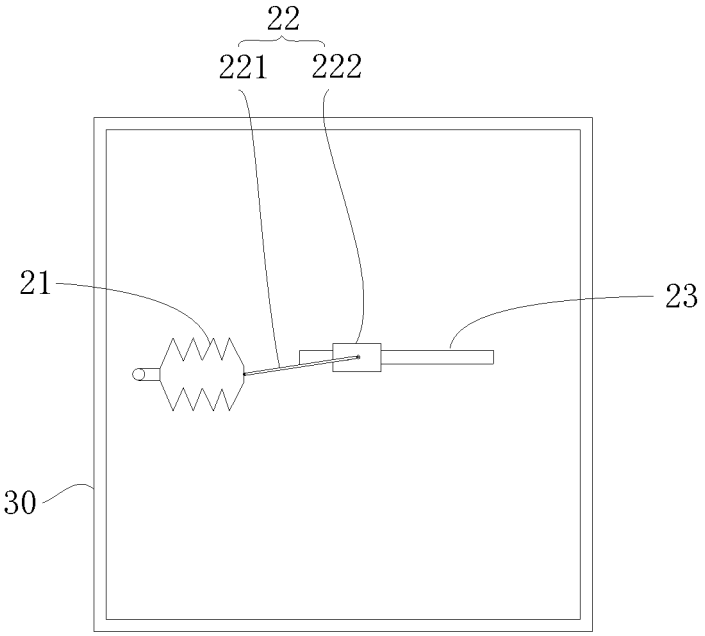
FIG. 12 is a schematic structural diagram of an exemplary inflating device and an exemplary mounting frame according to various embodiments of the present disclosure.

As shown in FIG. 12, FIG. 12 is a schematic structural diagram of an exemplary inflating device and an exemplary mounting frame according to various embodiments of the present disclosure. In some embodiments, the moving member 222 may be movably connected to the wristband main body 10, and the moving member 222 moves following a move of the wearing body 300 and can move relative to the wristband main body 10 to drive the inflating component 21 to expand and contract. It is also possible to use the moving following a move action of the moving member 222 and the wearing body 300 to drive the expanding and contracting of the inflating component 21, thereby satisfying the inflation requirement for the inflatable bag 12, and realizing tightening of the wristband 100.

As an optional implementation, when the moving member 222 is movably connected to the wristband main body 10, the inflating device 20 further includes a guiding part 23 provided on the wristband main body 10. The guiding part 23 extends along an expanding and contracting direction of the inflating component 21. The moving member 222 includes a sliding part, which cooperates with the guiding part 23 and can slide back and forth in an extending direction of the guiding part 23. Setting of the guiding part 23 can provide constraints for movement of the moving member 222, so that the moving member 222 moves in a direction in which the inflating component 21 can expand and contract during a process of moving following a move of the wearing body 300, so as to ensure driving effect of the inflating component 21.

In some optional embodiments, the guiding part 23 may adopt a structure of a guide rail. Correspondingly, the sliding part of the moving member 222 may be a structure that matches a shape of the guide rail and can be slidably fitted. The structure is simple, and is beneficial to ensure moving following a move requirements of the wearing body 300.

It can be understood that the wristband 100 provided in the foregoing embodiments is illustrated by taking the driving component 22 to drive one inflating component 21 as examples. This is an optional implementation manner, but the present disclosure is not limited to the foregoing manner.

Figure 13:
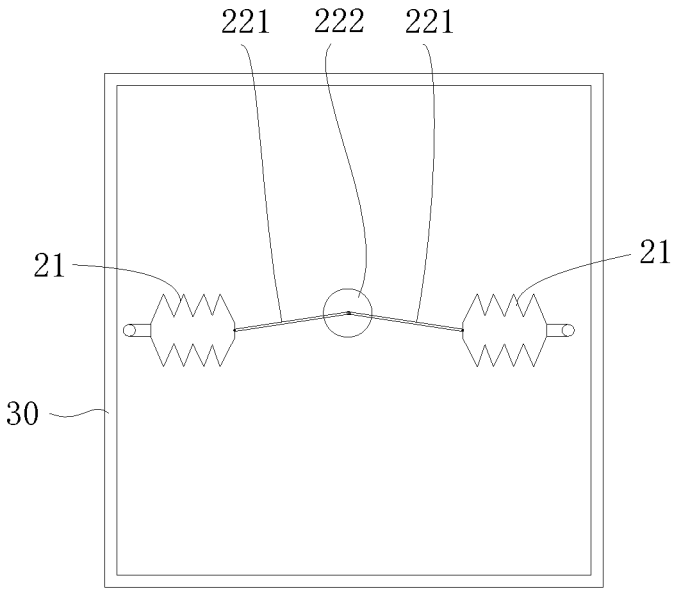
FIG. 13 is a schematic structural diagram of an exemplary inflating device and an exemplary mounting frame according to various embodiments of the present disclosure.

As shown in FIG. 13, FIG. 13 is a schematic structural diagram of an exemplary inflating device and an exemplary mounting frame according to various embodiments of the present disclosure. In some embodiments, the inflating component 21 may also be arranged in pairs, and the moving member 222 is connected to each inflating component 21 through the adapter 221. Two inflating components 21 arranged in pairs can be simultaneously driven by a same moving member 222. For example, the two inflating components 21 can be symmetrically distributed on both sides of the moving member 222 and connected to the moving member 222 through the adapter 221 respectively. When the moving member 222 moves following a move of the wearing body 300 and stretches one of the two inflating components 21, it will compress another of the two inflating components 21 to drive the expanding and contracting of the two inflating components 21 at a same time. The paired inflating components 21 can provide constraints for a movement path of the moving member 222, and improves a utilization rate of the kinetic energy obtained by the moving member 222 moving following a move of the wearing body 300.

Optionally, the paired inflating components 21 can be connected to a same inflatable bag 12. When the quantity of the inflatable bag 12 is two or more, the paired inflating components 21 can also be connected to different inflatable bags 12, as long as it can meet requirements of each inflatable bag 12.

Optionally, when the moving member 222 simultaneously drives the paired inflating components 21 to expand and contract, the moving member 222 may adopt a block structure. To reduce friction loss, the moving member 222 may also adopt a spherical structure, and an outer peripheral surface of the moving member 222 may be provided with hinge ears to facilitate the rotatable connection with the corresponding adapter 221.

It is understandable that the wristband 100 provided in the foregoing embodiments of the present disclosure is illustrated in a form of a bellows as an expanding and contracting component. This is an optional implementation manner, but the present disclosure is not limited to the foregoing manner.

Figure 14:
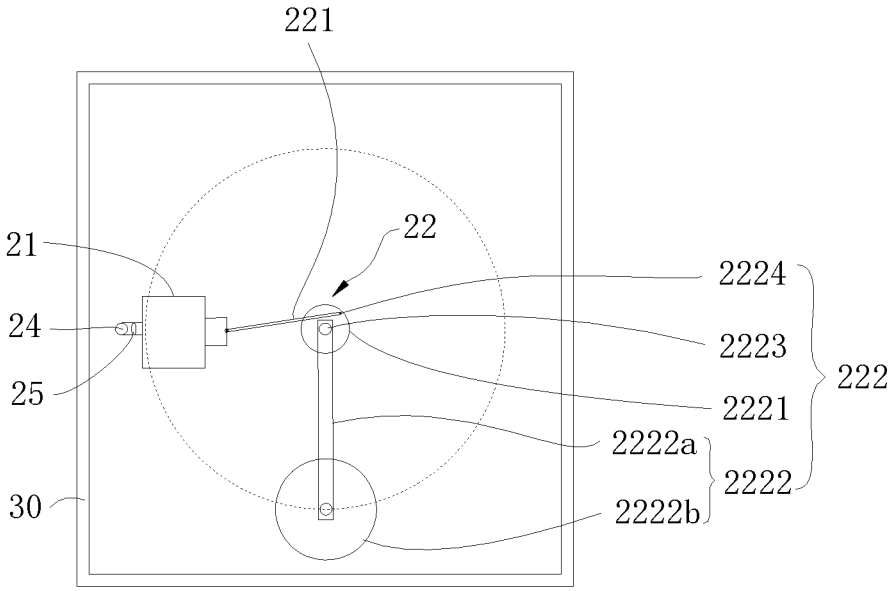
FIG. 14 is a schematic structural diagram of an exemplary inflating device and an exemplary mounting frame according to various embodiments of the present disclosure.

As shown in FIG. 14, FIG. 14 is a schematic structural diagram of an exemplary inflating device and an exemplary mounting frame according to various embodiments of the present disclosure. In some embodiments, the inflating component 21 may also include a telescopic cylinder. A cylinder of the telescopic cylinder has a gas inlet and an inflating hole communicating with the inflatable bag 12, and a cylinder rod of the telescopic cylinder is connected to the driving component 22. The inflating component 21 adopts a form of the telescopic cylinder, which can also meet the requirement of inflating the inflatable bag 12 under driving of the moving member 222. When the inflating component 21 adopts a structure of the telescopic cylinder, the cylinder rod of the telescopic cylinder can be connected to the adapter 221. In some optional embodiments, the two can be an integrated structure.

It is understandable that in the wristband 100 provided by the foregoing embodiments of the present disclosure, the release structure 13 is illustrated in a form of including the leak hole 131, which is an optional implementation. In some embodiments, the release structure 13 may also include a first control valve, which communicates with the inner cavity of the inflatable bag 12. The gas in the inflation bag 12 can be released or maintained by controlling opening and closing of the first control valve to ensure the slackness adjustment of the wristband 100. Optionally, the first control valve can be a solenoid valve, which is easy to control.

It is understandable that the wristband 100 provided in the above embodiments is illustrated by taking examples that the belt body 11 has two opposite free ends as a whole. This is only an optional implementation manner, but the present disclosure is not limited to the above manner.

Figure 15:
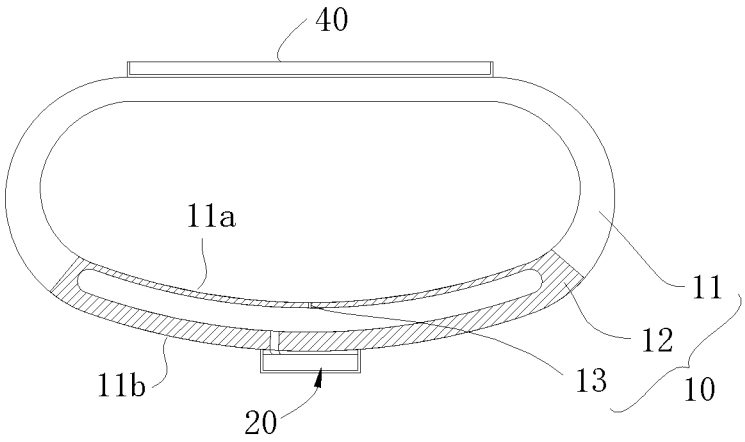
FIG. 15 is a schematic structural diagram of an exemplary wristband according to various embodiments of the present disclosure.

As shown in FIG. 15, FIG. 15 is a schematic structural diagram of an exemplary wristband according to various embodiments of the present disclosure. In some embodiments, the belt body 11 can be made into a closed ring as a whole. When the belt body 11 is used for a wristwatch, the dial 200 can be adhered to the wristband main body 10. A mounting seat 40 can be provided on the belt body 11 to mount the dial 200.

Figure 16:
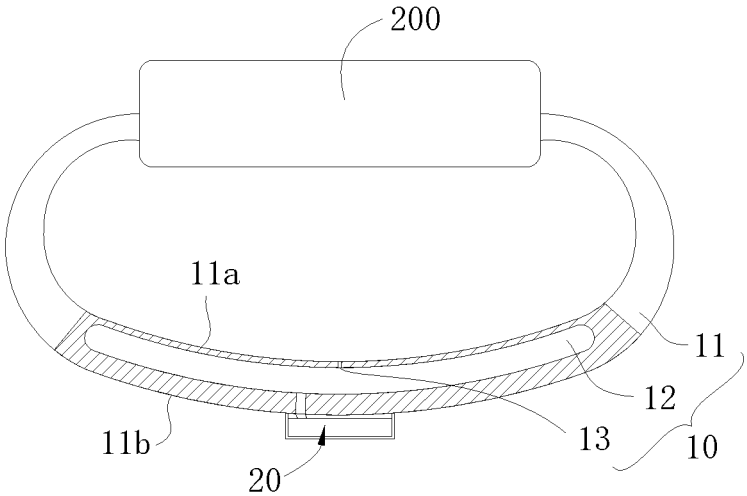
FIG. 16 is a schematic structural diagram of an exemplary wristwatch according to various embodiments of the present disclosure.
Figure 17:
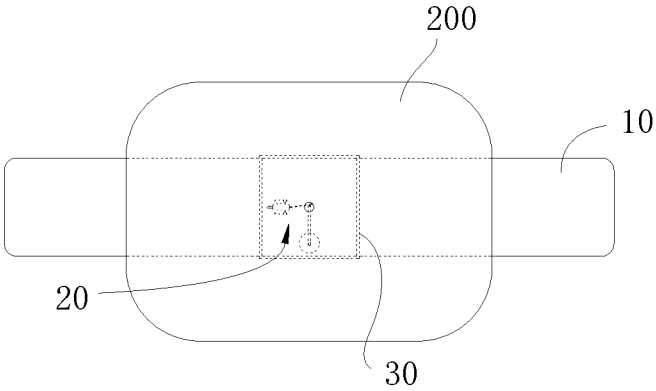
FIG. 17 is a top view of structures shown in FIG. 16.

As shown in FIG. 16 and FIG. 17, FIG. 16 is a schematic structural diagram of an exemplary wristwatch according to various embodiments of the present disclosure, and FIG. 17 is a top view of structures shown in FIG. 16.

On another hand, the embodiments of the present disclosure also provide a wristwatch, which includes the wristband 100 of the foregoing embodiments and the dial 200. The dial 200 is connected to the wristband 100, and together with the wristband 100 to form a closed ring 400. Optionally, the release structure 13 may be disposed facing towards the closed ring 400.

The wristwatch provided by the embodiments of the present disclosure includes the wristband 100 provided in the foregoing embodiments, and therefore, the slackness of the wristband 100 can be automatically adjusted according to the exercising states of the wearing body 300, which facilitates the slackness adjustment of the wristband 100. In addition, the corresponding dial 200 can be configured to display required information, such as time information, orientation information, body condition information such as the wearer's heart rate and blood pressure, and information such as exercise steps, etc., with high user experience.

According to the wristband and wristwatch provided by the embodiments of the present disclosure, the wristband includes the wristband main body and the inflating device. The wristband main body has the belt body and the inflatable bag arranged on the belt body. The inflating device includes the inflating component and the driving component. When the wristband is used in the wristwatch and encircles on the wearing body, the wristband adjusts its slackness to the wearing body according to the states of the wearer. For example, when the wearer is in the exercising state, the driving component will move following a move to drive the inflating component to inflate the inflatable bag, making the inflatable bag larger, and ensuring that the wristband is tighter on the wearer's wrist. In the non-exercising state, the release structure communicating with the inner cavity of the inflatable bag can be configured to release the gas from the inflatable bag to loosen the wristband, which is easy to operate and facilitates the slackness adjustment of the wristband.

Although the present disclosure has been described with reference to the embodiments, without departing from the scope of the present disclosure, various modifications can be made thereto and the components therein can be replaced with equivalents. In particular, as long as there is no structural conflict, the various technical features mentioned in the various embodiments can be combined in any manner. The present disclosure is not limited to the embodiments disclosed in the text, but includes all technical solutions falling within the scope of the claims.

What is claimed is:

1. A wristband, comprising:

a wristband main body, configured to encircle on a wearing body, wherein the wristband main body includes a belt body and an inflatable bag arranged on the belt body, and a release structure is configured in a wall part of the wristband main body that surrounds the inflatable bag and the release structure communicates with an inner cavity of the inflatable bag, to release gas from the inflatable bag; and an inflating device, provided on the wristband main body, wherein the inflating device includes an inflating component and a driving component, the inflating component communicates with the inflatable bag, and the driving component is configured to automatically move following a move of the wearing body without requiring a user to touch the driving component itself;

wherein the automatic movement of the driving component is generated by a transfer of kinetic energy from the move of the wearing body to the driving component; and wherein the automatic movement of the driving component following the move of the wearing body generates kinetic energy to drive the inflating component to inflate the inflatable bag.

2. The wristband according to claim 1, wherein:

the driving component includes an adapter and a moving member, that are rotatably connected to each other, one end of the adapter facing away from the moving member is connected to the inflating component, and the moving member moves following a move of the wearing body and drives the inflating component to expand and contract through the adapter.

3. The wristband according to claim 2, wherein:

the moving member is rotatably connected to the wristband main body, a rotation center of the moving member and the wristband main body is spaced apart from a rotation center of the adapter and the moving member, and the moving member moves following a move of the wearing body and rotates relative to the wristband main body, to drive the inflating component to expand and contract through the adapter.

4. The wristband according to claim 3, wherein:

the moving member includes a turntable and a swinging part connected to the turntable, a center of the turntable is rotatably connected to the wristband main body through a first shaft, the swinging part moves following a move of the wearing body and drives the turntable to rotate with the first shaft as a center of rotation, the adapter is rotatably connected to the turntable through a second shaft, and the second shaft and the first shaft are spaced apart from each other.

5. The wristband according to claim 4, wherein:

the swinging part includes a swing arm and a pendulum, one end of the swing arm is connected to the turntable, and another end of the swing arm protrudes out of the turntable along a radial direction of the turntable, and is connected to the pendulum.

6. The wristband according to claim 2, wherein:

the moving member is movably connected to the wristband main body, and the moving member moves following a move of the wearing body and moves relative to the wristband main body to drive the inflating component to expand and contract.

7. The wristband according to claim 6, wherein:

the inflating device further includes a guiding part disposed on the wristband main body, the guiding part extends along an expanding and contracting direction of the inflating component, the moving member includes a sliding part, and the sliding part cooperates with the guiding part and slides back and forth in an extending direction of the guiding part.

8. The wristband according to claim 6, wherein:

the inflating component is arranged in pairs, and the moving member is connected to each inflating component through the adapter.

9. The wristband according to claim 1, further comprising:

a mounting frame, provided on the wristband main body, wherein the inflating device is integrated in the mounting frame, and is connected to the wristband main body through the mounting frame.

10. The wristband according to claim 9, wherein:

the belt body has a flexible portion and a rigid fixing portion that are connected to each other, the inflatable bag is located at the flexible portion, and the mounting frame and the rigid fixing part are detachably connected to each other; or the mounting frame is bonded to the belt body.

11. The wristband according to claim 1, wherein:

the release structure includes a leak hole, and the leak hole communicates with the inner cavity of the inflatable bag and is disposed facing towards the wearing body.

12. The wristband according to claim 11, wherein:

a radial size of an interface between the inflating component and the inflatable bag is greater than or equal to a radial size of the leak hole.

13. The wristband according to claim 11, wherein:

a diameter of the leak hole is between 0.05 mm and 0.1 mm, and a diameter of the interface between the inflating component and the inflatable bag is between 1 mm and 1.5 mm.

14. The wristband according to claim 1, wherein:

the release structure includes a first control valve, and the first control valve communicates with the inner cavity of the inflatable bag.

15. The wristband according to claim 1, wherein:

the inflating device further includes a connecting pipe, the connecting pipe communicates with the inflating component and the inflatable bag, a second control valve is provided inside the connecting pipe, and the second control valve is unidirectionally communicated from the inflating component to the inflatable bag.

16. The wristband according to claim 1, wherein:

the inflating component includes a bellows, the bellows has a gas inlet hole and an inflating hole communicating with the inflatable bag, and one end of the bellows is connected to the driving component.

17. The wristband according to claim 1, wherein:

the inflating component includes a telescopic cylinder, a cylinder body of the telescopic cylinder has a gas inlet hole and an inflating hole communicating with the inflatable bag, and a cylinder rod of the telescopic cylinder is connected to the driving component.

18. The wristband according to claim 1, wherein:

the wristband main body further includes a diaphragm element, an outer periphery of the diaphragm element is connected to the belt body to form the inflatable bag, a thickness of the diaphragm element is smaller than a wall thickness of the belt body, the diaphragm element is disposed facing towards the wearing body and the belt body is disposed further away from the wearing body, and the release structure is disposed on the diaphragm element.

19. The wristband according to claim 1, wherein:

a quantity of the inflatable bag is two or more, the two or more inflatable bags are spaced apart on the belt body, and two adjacent inflatable bags communicate with each other.

20. A wristband, comprising:

a wristband main body, configured to encircle on a wearing body, wherein the wristband main body includes a belt body and an inflatable bag arranged on the belt body, and a release structure is configured in a wall part of the wristband main body that surrounds the inflatable bag and the release structure communicates with an inner cavity of the inflatable bag, to release gas from the inflatable bag; and an inflating device, provided on the wristband main body, wherein the inflating device includes an inflating component and a driving component, the inflating component communicates with the inflatable bag, and the driving component is configured to move following a move of the wearing body and to drive the inflating component to inflate the inflatable bag, wherein:

the inflatable bag is arranged inside the belt body and divides the belt body into a first section and a second section that are disposed oppositely to each other; in an arrangement direction of the first section and the second section, a wall thickness of the first section is smaller than a wall thickness of the second section; the first section is disposed facing towards the wearing body and the second section is disposed further away from the wearing body; and the release structure is disposed on the first section.

21. A wristwatch, comprising:

a wristband, including:

a wristband main body, configured to encircle on a wearing body, wherein the wristband main body includes a belt body and an inflatable bag arranged on the belt body, and a release structure is configured in a wall part of the wristband main body that surrounds the inflatable bag and the release structure communicates with an inner cavity of the inflatable bag, to release gas from the inflatable bag; and an inflating device, provided on the wristband main body, wherein the inflating device includes an inflating component and a driving component, the inflating component communicates with the inflatable bag, and the driving component is configured to automatically move following a move of the wearing body without requiring a user to touch the driving component itself;

wherein the automatic movement of the driving component is generated by a transfer of kinetic energy from the move of the wearing body to the driving component; and wherein the automatic movement of the driving component following the move of the wearing body generates kinetic energy to drive the inflating component to inflate the inflatable bag; and a dial, connected to the wristband, and together with the wristband to form a closed ring, wherein the release structure is arranged facing towards the closed ring.

* * * * *